US006519788B1

(12) United States Patent
Epple

(10) Patent No.: US 6,519,788 B1
(45) Date of Patent: Feb. 18, 2003

(54) VENTED AUTOMATIC COVER FOR A SWIMMING POOL

(75) Inventor: Thomas A. Epple, Fort Wayne, IN (US)

(73) Assignee: Fort Wayne Pools, Inc., Fort Wayne, IN (US)

( * ) Notice: Subject to any disclaimer, the term of this patent is extended or adjusted under 35 U.S.C. 154(b) by 0 days.

(21) Appl. No.: 09/699,707

(22) Filed: Oct. 30, 2000

(51) Int. Cl.[7] ..... E04H 4/00
(52) U.S. Cl. ..... 4/498; 4/503
(58) Field of Search ..... 4/498–500, 502, 4/503

(56) References Cited

U.S. PATENT DOCUMENTS 2,754,900 A * 7/1956 Karobonik et al. ..... 4/498
3,344,440 A * 10/1967 Langer ..... 4/498
4,939,798 A * 7/1990 Last ..... 4/502
5,170,517 A * 12/1992 Stegmeier ..... 4/503
5,282,282 A * 2/1994 Shehan et al. ..... 4/503
5,887,296 A * 3/1999 Handwerker ..... 4/498

* cited by examiner

*Primary Examiner*—Gregory Huson
*Assistant Examiner*—Tuan Nguyen

(57) ABSTRACT

A swimming pool has a plurality of walls with a pair of side walls on opposite sides of the pool. The plurality of walls define a target water level within the swimming pool. A pair of tracks are respectively associated with each side wall and positioned above the target water level. A cover includes a pair of longitudinal side edges, with each side edge carried by a corresponding track. The cover includes at least one gas vent along each side edge and above the target water level.

7 Claims, 2 Drawing Sheets

Fig. 1
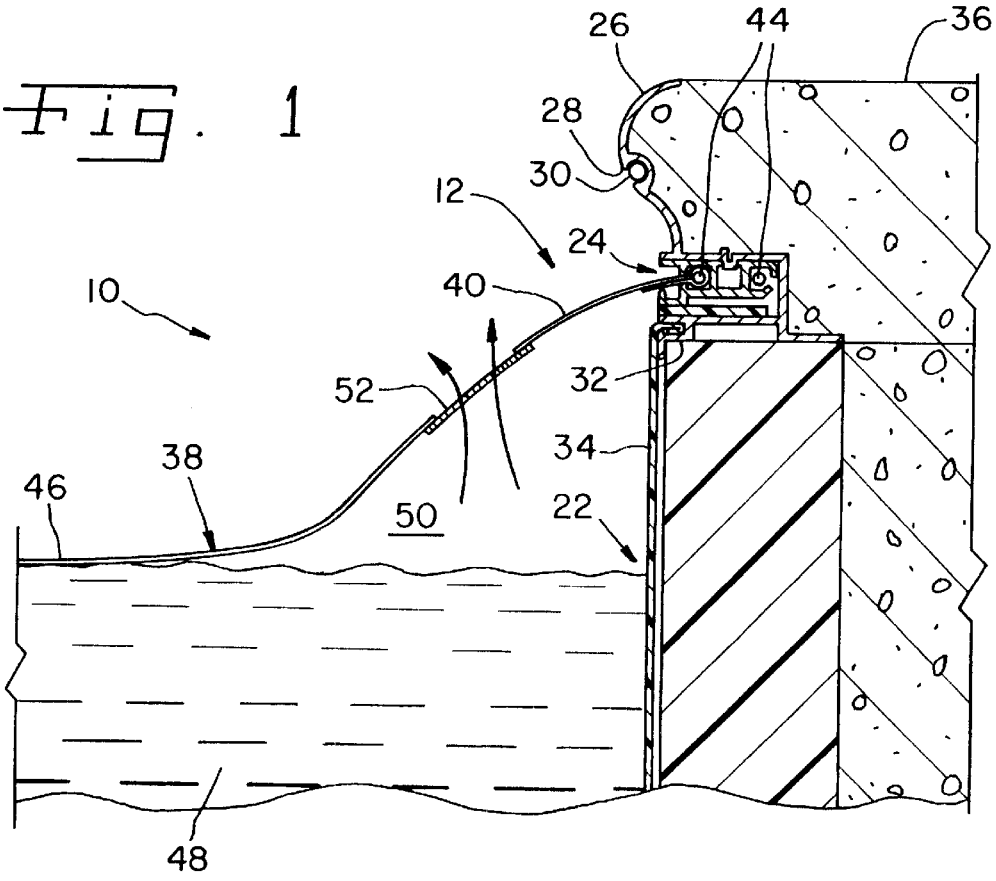
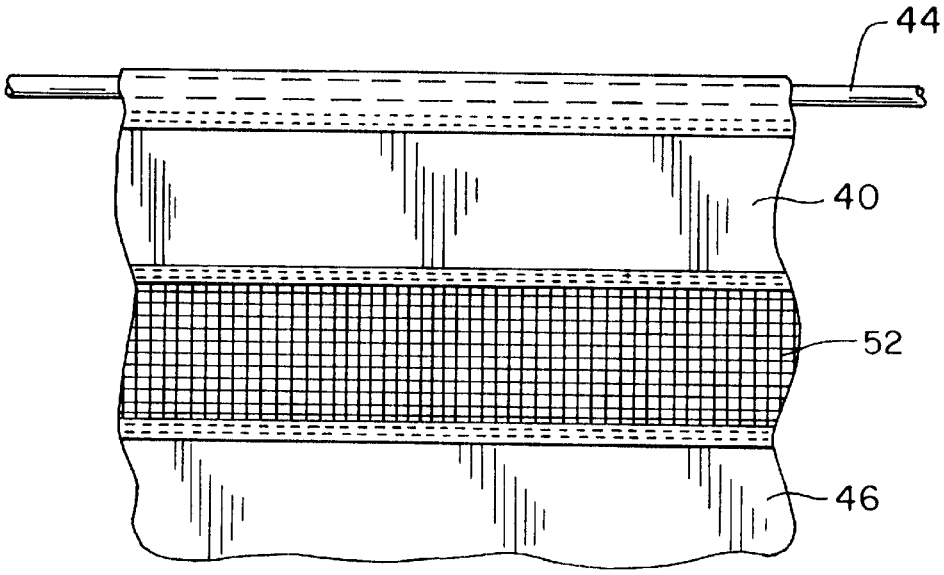
Fig. 3

VENTED AUTOMATIC COVER FOR A SWIMMING POOL

BACKGROUND OF THE INVENTION

1. Field of the Invention

The present invention relates to swimming pools, and, more particularly, to automatic covers for a swimming pool.

2. Description of the Related Art

Swimming pools are commonly covered to prevent debris from entering the pool and to heat the pool in the case of a solar cover. An automatic pool cover provides convenience for a user by allowing the cover to be easily extended over the pool during periods of non-use, and retracted during periods of use. Typically, the automatic pool cover is retained within a cover box at an end of the pool opposite from the walk-in steps (usually the deep end). A pair of tracks extend along each side wall of the pool, and can either be mounted to the concrete deck or incorporated into the coping which surrounds the pool. Regardless of whether the track is deck mounted our integral with the coping, the track is always positioned above a target water level in the pool. When in an extended position over the pool, the automatic pool cover hangs from the track and slopes away from the track toward the middle of the pool. The center portion of the cover rests on and is supported by the water in the pool.

A problem with an automatic pool cover as described above is that such covers are constructed from a high strength, durable, non-porous tarp material which covers the pool during periods of non-use. The area along the side walls adjacent the tracks defines an air chamber below the automatic pool cover and above the water where the cover slopes from the track to the upper surface of the water. The water typically contains multiple different chemicals therein such as chlorine, acid, clarifier, etc. The chemicals within the water evaporate into the air space along the side walls of the pool and remain in the chamber in a gaseous state until the pool cover is opened. These evaporated chemicals within the air chamber along each side wall tend to deteriorate and shorten the life of the cover and vinyl liner because of the constant exposure to the gaseous chemicals when the cover is in an extended position over the pool.

What is needed in the art is an automatic pool cover which does not trap evaporated chemicals within the air space along the side walls below the cover and above the water level.

SUMMARY OF THE INVENTION

The present invention provides a swimming pool cover having one or more gas vents along peripheral edges thereof which allow chemicals which evaporate from the water to escape to the ambient environment.

The invention comprises, in one form thereof, a swimming pool having a plurality of walls with a pair of side walls on opposite sides of the pool. The plurality of walls define a target water level within the swimming pool. A pair of tracks are respectively associated with each side wall and positioned above the target water level. A cover includes a pair of longitudinal side edges, with each side edge carried by a corresponding track. The cover includes at least one gas vent along each side edge and above the target water level.

An advantage of the present invention is that chemicals which evaporate from the water into air chambers between the cover and water are vented to the ambient environment to prevent degradation to the cover and/or liner.

Another advantage is that the gas vents do not affect the overall shape or operation of the automatic cover.

Yet another advantage is that the gas vents may be configured to allow evaporated chemicals to vent to the ambient environment while preventing foreign matter or debris from passing therethrough and into the water in the pool.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

FIG. 1 is a fragmentary, sectional view of a portion of a swimming pool, including an embodiment of an automatic pool cover assembly of the present invention;

FIG. 3 is a fragmentary, top view of a portion of the automatic pool cover shown in FIGS. 1 and 2.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
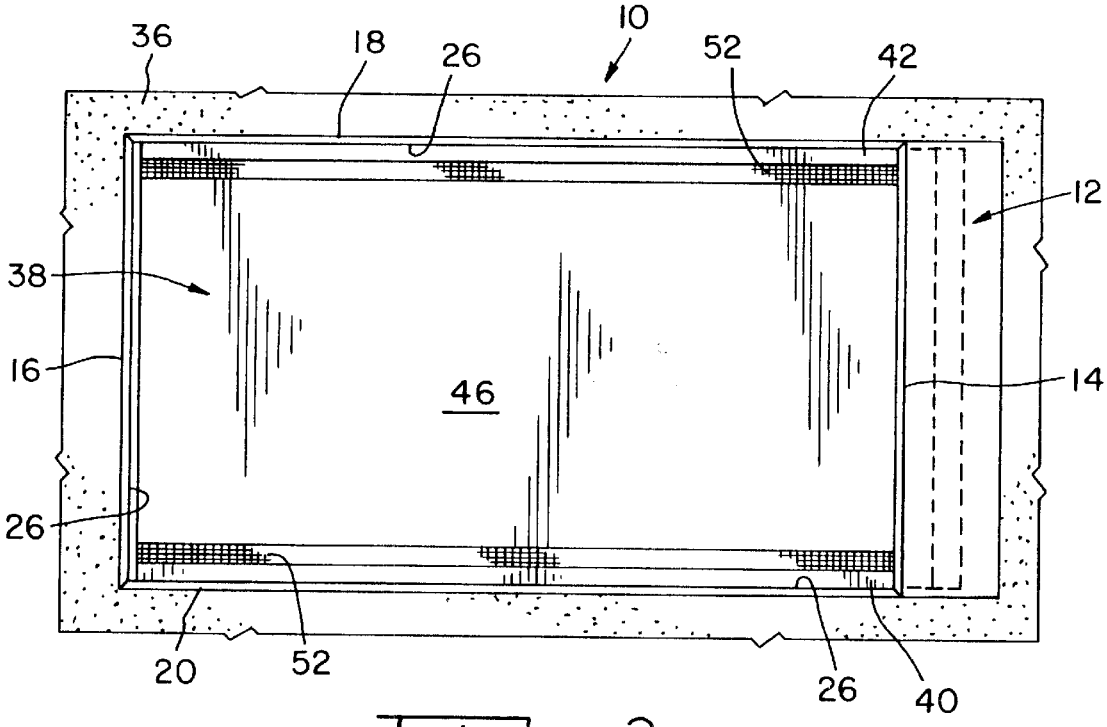
FIG. 2 is top view of the swimming pool of FIG. 1.

Referring now to the drawings, and more particularly to FIGS. 1 and 2, there is shown an embodiment of a swimming pool 10, which includes an automatic pool cover assembly 12 of the present invention. Swimming pool 10 also includes a plurality of walls, including a pair of opposite end walls 14, 16 and a pair of opposite side walls 18, 20. End walls 14, 16 and side walls 18, 20 define a target water level within swimming pool 10. To wit, end walls 14, 16 and/or side walls 18, 20 typically include one or more skimmers (not shown) and one or more water returns (not shown). It is usually desirable to fill swimming pool 10 to a specified degree for proper operation of the skimmers, etc. Of course, the actual water level may vary somewhat from the target water level and still provide effective operation of swimming pool 10.

A pair of tracks 24 are respectively associated with side walls 18, 20 and positioned above the target water level 22. Only a single track 24 is illustrated in detail in FIG. 1. Track 24 is actually part of a coping 26 attached to the top of side wall 20. Coping 26 also includes a fiber optic light slot 28 carrying a fiber optic light 30; and a liner bead slot 32 carrying a vinyl liner 34. Coping 26 defines a facia surrounding the top, perimeter of swimming pool 10, and also is used as a form for concrete deck 36. Coping 26 is coupled in an end-to-end manner around at least three sides of swimming pool 10, including end wall 16 and side walls 18, 20. Thus, opposite side wall 18 likewise includes a substantially identically configured track 24.

Cover 38 includes a pair of longitudinal side edges 40, 42. Each side edge 40, 42 is carried by a corresponding track 24 along respective side walls 18, 20. A rope carrier 44 is sewn into cover 38 along each side edge 40, 42. Rope carrier 44 is received within a corresponding track 24 for allowing cover 38 to be extended and retracted over pool 10. The term "rope carrier", as used herein, is intended to mean any elongate element which may be coupled with a corresponding side edge 40, 42 and carried within a corresponding track 24, such as, e.g., nylon, hemp or steel rope.

As shown in FIG. 1, cover 38 includes a center portion 46 which rests on and is supported by water 48. Since track 24 is positioned above target water level 22, cover 38 is suspended by track 24 and slopes toward water 48. Thus, an air chamber 50 is defined above water 48 and below cover 38 adjacent side edges 40, 42. Since water 48 includes treatment chemicals therein such as chlorine, acid, clarifier, etc., it has been found that gas from the various chemicals within water 48 evaporates into chamber 50 adjacent side edges 40, 42. The chemical laden gas within chamber 50 may cause a deterioration of both cover 38 as well as vinyl liner 34 over a period of time, thereby resulting in a shortened life of cover 38 and/or liner 34.

According to an aspect of the present invention, cover 38 includes at least one gas vent 52 which is disposed in fluid communication with chamber 50. Each gas vent 52 is positioned along a corresponding side edge 40, 42 and in fluid communication with chamber 50, thereby allowing gas within chamber 50 to flow to the ambient environment. The exact position of each gas vent 52 is not critical as long as it is above water 48 and in communication with chamber 50. Since swimming pool 10 is typically much wider than the width of chamber 50, each gas vent 52 is positioned a desired distance away from and along a corresponding side edge 40, 42 which allows gas vent 52 to remain in communication with chamber 50.

In the embodiment shown, a single gas vent extends substantially along the length of each side edge 40, 42 of cover 38. Each gas vent 52 along the corresponding side edge 40, 42 is in the form of a nylon mesh which is sized to allow gas to vent therethrough to the ambient environment, while preventing debris such as grass, sticks or the like from passing therethrough. The mesh is in the form of a separate mesh piece which is sewn to adjacent panels of cover 38.

During use, cover 38 may be moved to an extended position covering swimming pool 10 as shown in FIG. 2. Water 48 is typically continuously circulated within swimming pool 10. The atmospheric conditions, as well as the circulation of water 48 results in evaporation of chemicals within water 48 into chamber 50 along each side wall 18, 20. Gas vents 52 allow the evaporated gas to escape to the ambient environment, thereby inhibiting damage to cover 38 and/or liner 34 as a result of continued exposure to chemicals within chamber 50 which would otherwise occur.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool, comprising:

a plurality of walls including a pair of side walls on opposite sides of said pool, said plurality of walls defining a target water level;

a pair of tracks, each track associated with said respective side wall and positioned above said target water level;

a cover including a pair of longitudinal side edges, each side edge carried by said corresponding track, said cover including at least one gas vent along each side edge and above said target water level, said cover having a water impermeable center portion adapted to be support by water when said cover is extended over said pool.

2. The swimming pool of claim 1, wherein said at least one gas vent along each said side edge comprises a single gas vent.

3. The swimming pool of claim 2, wherein said single gas vent extends substantially along a length of said corresponding track.

4. The swimming pool of claim 1, wherein each said gas vent comprises a mesh.

5. The swimming pool of claim 4, wherein said mesh is sized to allow gas to vent therethrough and prevent debris from passing therethrough.

6. The swimming pool of claim 4, wherein said mesh is a separate mesh piece which is attached to said cover.

7. The swimming pool of claim 1, further comprising a coping attached to each side wall, said coping including each track.

* * * * *